US011798477B1

(12) United States Patent
Zhou et al.

(10) Patent No.: US 11,798,477 B1
(45) Date of Patent: Oct. 24, 2023

(54) PIXEL CIRCUIT, DISPLAY PANEL, AND DISPLAY APPARATUS

(71) Applicant: HKC CORPORATION LIMITED, Shenzhen (CN)

(72) Inventors: Renjie Zhou, Guangdong (CN); Danrong Wang, Guangdong (CN); Tian He, Guangdong (CN); Mengting Wang, Guangdong (CN); Xue Cao, Guangdong (CN); Kaikai Jiu, Guangdong (CN); Xiaobing Li, Guangdong (CN); Gangwei Fu, Guangdong (CN); Haoxuan Zheng, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/083,246

(22) Filed: Dec. 16, 2022

(30) Foreign Application Priority Data

Aug. 30, 2022 (CN) ..... 202211049501.X

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2300/0819* (2013.01); *G09G 2300/0842* (2013.01); *G09G 2310/0251* (2013.01); *G09G 2310/0262* (2013.01); *G09G 2310/061* (2013.01); *G09G 2320/0233* (2013.01); *G09G 2320/043* (2013.01); *G09G 2320/045* (2013.01)

(58) Field of Classification Search
CPC ..... G09G 3/3233; G09G 3/3291; G09G 2300/0819; G09G 2300/0842; G09G 2310/0262; G09G 2310/061; G09G 2310/0251; G09G 2320/0233; G09G 2320/043; G09G 2320/045
USPC ..... 345/212
See application file for complete search history.

(56) References Cited

U.S. PATENT DOCUMENTS 10,140,928 B2 * 11/2018 Wang ..... G09G 3/3283
11,145,241 B2 * 10/2021 Chen ..... G09G 3/3233
2008/0224965 A1 * 9/2008 Kim ..... G09G 3/3233 345/76
2013/0057532 A1 * 3/2013 Lee ..... G09G 3/3225 345/76

(Continued)

*Primary Examiner* — Tom V Sheng
(74) *Attorney, Agent, or Firm* — HAUPTMAN HAM, LLP

(57) ABSTRACT

A pixel circuit, display panel, and a display apparatus are provided in the disclosure. The pixel circuit includes a light-emitting unit and a drive transistor. The light-emitting unit is electrically coupled with a second power supply voltage terminal. The drive transistor is configured to drive the light-emitting unit to emit light. The light-emitting control sub-circuit is configured to control the light-emitting unit to emit light in response to a light-emitting control signal. The first reset sub-circuit is configured to write a reference voltage written at the reference voltage terminal into the gate of the drive transistor and a first terminal of the energy storage element in respond to a first reset signal. The switch sub-circuit is configured to change a gate voltage of the drive transistor. The second reset sub-circuit is configured to respond to the first reset signal.

20 Claims, 5 Drawing Sheets

(56) References Cited

U.S. PATENT DOCUMENTS

| | | | | |
|---|---|---|---|---|
| 2014/0062331 | A1* | 3/2014 | Nam | G09G 3/3233 315/226 |
| 2014/0084805 | A1* | 3/2014 | Kim | G09G 3/2048 315/240 |
| 2014/0152719 | A1* | 6/2014 | Jung | G09G 3/3233 345/691 |
| 2015/0187276 | A1* | 7/2015 | Shim | G09G 3/3291 345/77 |
| 2016/0210898 | A1* | 7/2016 | Tsuge | G09G 3/3233 |
| 2016/0253958 | A1* | 9/2016 | Ma | G09G 3/3233 345/211 |
| 2016/0343300 | A1* | 11/2016 | Wang | G09G 3/3233 |
| 2017/0116918 | A1* | 4/2017 | Dong | G09G 3/20 |
| 2018/0130411 | A1* | 5/2018 | Zhou | G09G 3/3225 |
| 2018/0374419 | A1* | 12/2018 | Chen | G09G 3/3233 |
| 2020/0090591 | A1* | 3/2020 | Wang | G09G 3/3233 |
| 2020/0243005 | A1* | 7/2020 | Li | G09G 3/3225 |
| 2020/0410924 | A1* | 12/2020 | Xiong | G09G 3/32 |
| 2021/0210005 | A1* | 7/2021 | Zhou | G09G 3/325 |
| 2021/0241688 | A1* | 8/2021 | Yin | G09G 3/3233 |
| 2022/0020330 | A1* | 1/2022 | Cao | G09G 3/3258 |
| 2022/0051627 | A1* | 2/2022 | Yang | G09G 3/3233 |
| 2022/0076631 | A1* | 3/2022 | Dong | G09G 3/3258 |
| 2022/0076632 | A1* | 3/2022 | Tang | G09G 3/3275 |
| 2022/0199038 | A1* | 6/2022 | Kim | G09G 3/3291 |
| 2022/0262313 | A1* | 8/2022 | Wang | G09G 3/3233 |
| 2022/0375408 | A1* | 11/2022 | Dong | G09G 3/3241 |
| 2023/0005426 | A1* | 1/2023 | Gao | G09G 3/3233 |
| 2023/0120765 | A1* | 4/2023 | Wang | G09G 3/3275 345/212 |

* cited by examiner

PIXEL CIRCUIT, DISPLAY PANEL, AND DISPLAY APPARATUS

CROSS-REFERENCE TO RELATED APPLICATIONS

This application claims priority under 35 U.S.C. § 119(a) to Chinese Patent Application No. 202211049501.X, filed Aug. 30, 2022, the entire disclosure of which is incorporated herein by reference.

TECHNICAL FIELD

This disclosure relates to the field of display technology, and in particular, to a pixel circuit, a display panel including the pixel circuit, and a display apparatus including the display panel.

BACKGROUND

Due to advantages of active-matrix organic light-emitting diodes (AMOLEDs) such as wide color gamut, fast response, high contrast, good flexibility, and power saving, AMOLED-related products (such as AMOLED displays) have become more and more popular in recent years.

However, when the AMOLED display works for a long period of time, a threshold voltage may drift due to a temperature increase of thin film transistors (TFTs). In addition, the threshold voltage of the TFTs may also drift when a display panel works in an environment where the temperature varies. A threshold voltage drift caused by the above reasons will result in an uneven threshold voltage, which will lead to unstable display, uneven brightness, color shift, and the like in the display panel of the AMOLED display, thus affecting the overall image display effect.

SUMMARY

In a first aspect, a pixel circuit is provided in the disclosure. The pixel circuit includes a light-emitting unit and a drive transistor. The light-emitting unit is electrically coupled with a second power supply voltage terminal. The drive transistor has a gate electrically coupled with a first reset sub-circuit, a switch sub-circuit, and an energy storage element, a source electrically coupled with a first power supply voltage terminal, and a drain electrically coupled with a light-emitting control sub-circuit. The drive transistor is configured to drive the light-emitting unit to emit light. The light-emitting control sub-circuit is electrically coupled with a light-emitting control signal terminal and the light-emitting unit, and is configured to control the light-emitting unit to emit light in response to a light-emitting control signal written at the light-emitting control signal terminal. The first reset sub-circuit is electrically coupled with a reference voltage terminal, a first reset signal terminal, the switch sub-circuit, and the energy storage element, and is configured to write a reference voltage written at the reference voltage terminal into the gate of the drive transistor and a first terminal of the energy storage element in respond to a first reset signal written at the first reset signal terminal. The switch sub-circuit is electrically coupled with a second reset sub-circuit and the energy storage element and configured to change a gate voltage of the drive transistor. The second reset sub-circuit is electrically coupled with the first reset signal terminal and configured to respond to the first reset signal. The energy storage element is electrically coupled with a third reset sub-circuit and a data writing sub-circuit and configured to change the gate voltage of the drive transistor. The third reset sub-circuit is electrically coupled with a second reset signal terminal and the data writing sub-circuit and configured to respond to a second reset signal written at the second reset signal terminal. The data writing sub-circuit is electrically coupled with a data voltage terminal and a scan signal terminal and configured to write a data voltage written at the data voltage terminal into a second terminal of the energy storage element in respond to a control data writing signal written at the scan signal terminal.

In a second aspect, a display panel is further provided in the disclosure. The display panel has an active area and an inactive area surrounding the active area. The display panel includes multiple pixel circuits provided in the first aspect.

In a third aspect, a display apparatus is further provided. The display apparatus includes a signal generating circuit and the display panel provided in the second aspect. The signal generating circuit is configured to provide the display panel with scan driving signals, data driving signals, and control signals.

BRIEF DESCRIPTION OF THE DRAWINGS

To describe the technical solutions in the embodiments of the disclosure more clearly, the following briefly introduces the accompanying drawings required for describing the embodiments. Apparently, the accompanying drawings in the following description illustrate some embodiments of the disclosure. Those of ordinary skill in the art may also obtain other drawings based on these accompanying drawings without creative efforts.

DETAILED DESCRIPTION

Figure 1:
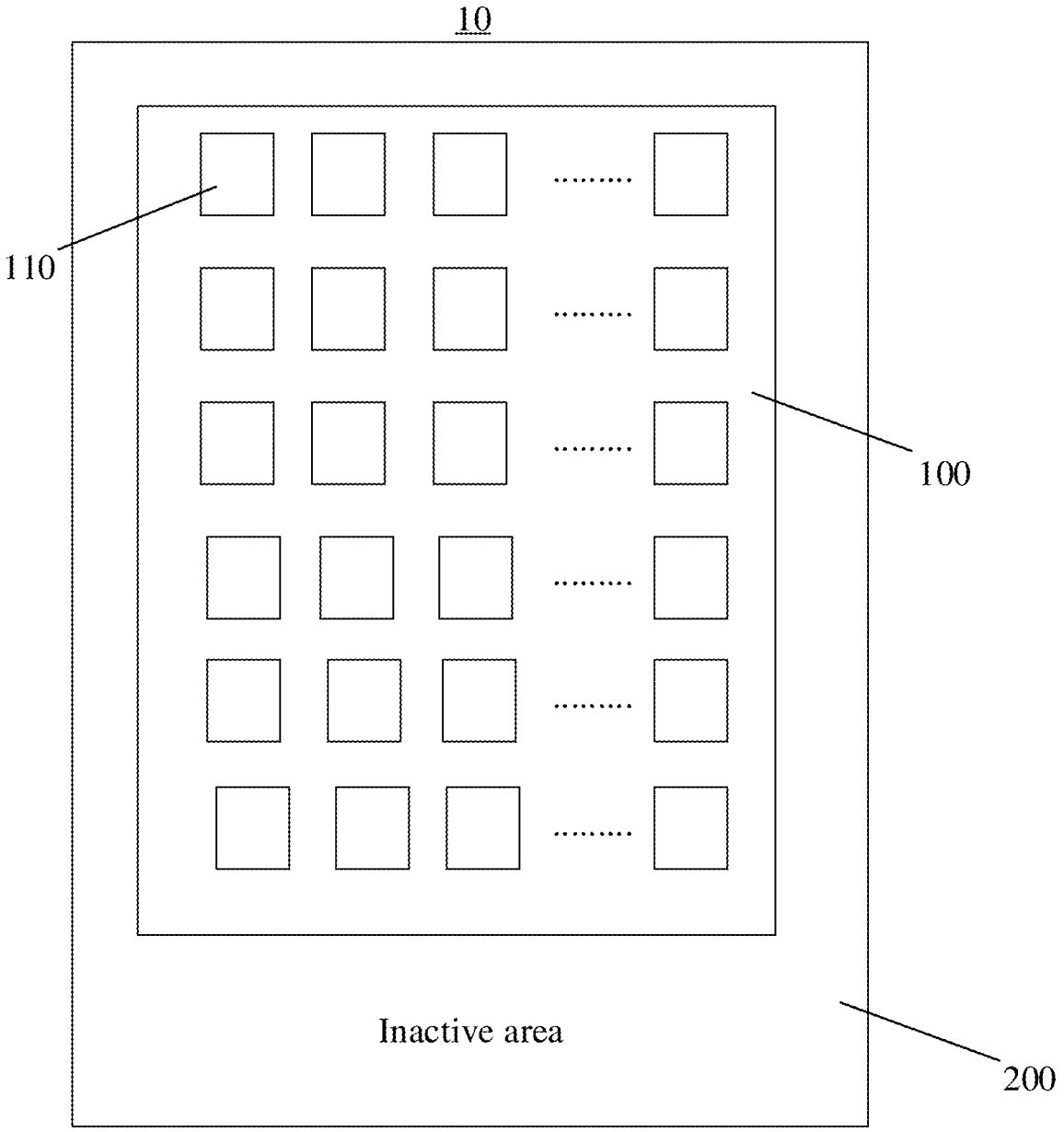
FIG. 1 is a schematic structural diagram of a display panel provided in an embodiment of the disclosure.

For ease understanding of the disclosure, the disclosure is described more completely with reference to the accompanying drawings hereinafter. The accompanying drawings illustrate preferred embodiments of the disclosure. However, the disclosure can be implemented in various forms and is not limited to the embodiments described herein. Rather, these embodiments are provided for a more thorough and comprehensive understanding of the disclosure.

The following embodiments are described with reference to the accompanying drawings to exemplify particular embodiments that may be implemented by the disclosure. The serial numbers themselves, such as "first" and "second" are used herein to distinguish the objects described, and do not have any sequential or technical meaning. The terms "connection" and "coupling" in the disclosure include direct and indirect connections (couplings), unless otherwise specified. Directional terms such as "up", "down", "front", "back", "left", "right", "inside", "outside", "side", and the like referred to herein which are only for directions with reference to the accompanying drawings. Therefore, the directional terms used herein are intended to better and more clearly illustrate and understand the disclosure, rather than explicitly or implicitly indicate that apparatus or components referred to herein must have a certain direction or be configured or operated in a certain direction and therefore cannot be understood as limitation on the disclosure.

It is noted that, in the description of the disclosure, terms "install", "couple", "connect", and "interconnect" should be understood in a broad sense unless otherwise expressly specified and limited. For example, the terms "install", "couple", "connect", and "interconnect" may refer to fixedly connect, detachably connect, or integrally connect, may refer to mechanically connect, and may refer to a directly connect, indirectly connect through an intermediate medium, or an intercommunicate interiors of two elements. For those of ordinary skill in the art, the specific meanings of the above terms in the disclosure can be understood according to specific situations. It is noted that, the terms such as "first" and "second" in the specification, claims, and the accompanying drawings of the disclosure are used for distinguishing between different objects rather than describing a particular order.

In addition, terms such as "include", "may include", "contain", or "may contain" used herein indicate the existence of the corresponding function, operation, element, etc. disclosed, and do not limit the other one or more further functions, operations, elements, etc. In addition, the term "include" or "contain" indicates the existence of the corresponding feature, number, step, operation, element, component, or combination thereof disclosed in the specification, without excluding the existence or addition of one or more other features, numbers, steps, operations, elements, components, or combinations thereof, and is intended to cover non-exclusive inclusion. In addition, when describing the embodiments of the disclosure, the term "may" is used to denote "one or more embodiments of the disclosure". Also, the term "exemplary" is intended to refer to examples or illustrations.

Unless otherwise defined, all technical and scientific terms used herein have the same meaning as commonly understood by those skilled in the art of the disclosure. The terms used herein in the disclosure are for merely describing embodiments rather than intending to limit the disclosure.

In the embodiments of the disclosure, technical schemes of a pixel circuit, a display panel with the pixel circuit, and a display apparatus with the display panel are provided to solve uneven display brightness and unstable display of a display screen due to uneven light emission of a light-emitting element caused by a threshold voltage drift in a thin film transistor (TFT), which are elaborated in the following embodiments.

Refer to FIG. 1, which is a schematic structural diagram of a display panel provided in an embodiment of the disclosure. In this embodiment, the display panel 10 includes an active area 100 and an inactive area 200. The active area 100 is used for image display. The inactive area 200 surrounds the active area 100 and is not used for image display. The display panel 10 further includes multiple pixel circuits 110. The multiple pixel circuits 110 are disposed in the active area 100 for image display. It can be understood that, in some embodiments, the display panel 10 may be an organic light-emitting diode (OLED) panel, but the disclosure is not limited thereto.

It can be understood that the display panel 10 can be applied to an electronic device including personal digital assistant (PDA) and/or music player functions and so on, such as a mobile phone, a tablet computer, a wearable electronic device with wireless communication functions (for example, a smart watch, a smart bracelet), etc. The aforementioned electronic device may also be other electronic devices, such as a laptop computer having a touch-sensitive surface (for example, a touch panel). In some embodiments, the electronic device may have a communication function, that is, the electronic device may establish communication with a network through second generation mobile phone communication technical specifications (2G), third generation mobile phone communication technical specifications (3G), fourth generation mobile phone communication technical specifications (4G), fifth generation mobile phone communication specifications (5G), wireless local area network (W-LAN), or communication methods that may appear in the future, which is not further limited in the embodiments of the disclosure for the sake of simplicity.

Figure 2:
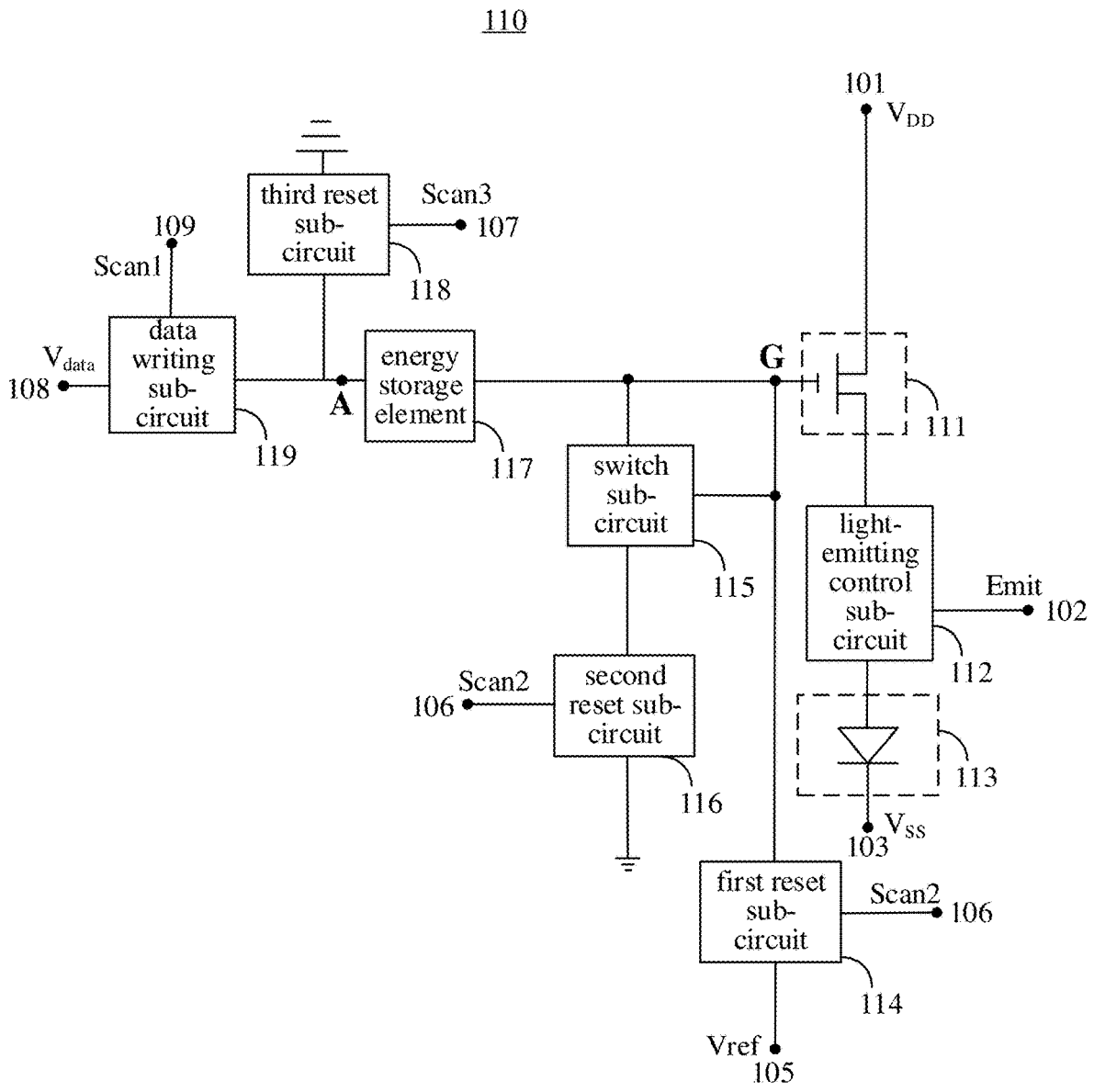
FIG. 2 is a schematic circuit diagram of a pixel circuit provided in a first embodiment of the disclosure.

In a first aspect, the pixel circuit 110 is provided. Further refer to FIG. 2, which is a schematic circuit diagram of a pixel circuit provided in a first embodiment of the disclosure. As illustrated in FIG. 2, the pixel circuit 110 provided in the disclosure may at least include a drive transistor 111, a light-emitting control sub-circuit 112, a light-emitting unit 113, a first reset sub-circuit 114, a switch sub-circuit 115, a second reset sub-circuit 116, an energy storage element 117, a third reset sub-circuit 118, and a data writing sub-circuit 119.

In an embodiment of the disclosure, the drive transistor 111 has a gate electrically coupled with the first reset sub-circuit 114, the switch sub-circuit 115, and the energy storage element 117, a source electrically coupled with a first power supply voltage terminal 101, and a drain electrically coupled with the light-emitting control sub-circuit 112, and the drive transistor 111 is configured to drive the light-emitting unit 113 to emit light. In an example, the first power supply voltage terminal 101 is configured to receive a first power supply voltage $V_{DD}$.

The light-emitting control sub-circuit 112 is electrically coupled with the drain of the drive transistor 111, a light-emitting control signal terminal 102, and the light-emitting unit 113, and configured to control the light-emitting unit 113 to emit light in response to a light-emitting control signal written at the light-emitting control signal terminal 102.

The light-emitting unit 113 has a positive pole electrically coupled with the light-emitting control sub-circuit 112 and a negative pole electrically coupled with the second power supply voltage terminal 103. In an example, the second power supply voltage terminal 103 is configured to receive a second power supply voltage Vss.

The first reset sub-circuit 114 is electrically coupled with a reference voltage terminal 105, a first reset signal terminal 106, the gate of the drive transistor 111, the switch sub-circuit 115, and the energy storage element 117, and configured to write a reference voltage $V_{ref}$ written at the reference voltage terminal 105 into the gate of the drive transistor 111 and a first terminal of the energy storage element 117 in response to a first reset signal Scan2 written at the first reset signal terminal 106. In an example, the reference voltage $V_{ref}$ written at the reference voltage terminal 105 can be controlled externally, so as to change a voltage value of the reference voltage $V_{ref}$. The voltage value of the reference voltage $V_{ref}$ can be adjusted to achieve an optimum voltage according to a situation of the display panel.

The switch sub-circuit 115 is electrically coupled with the gate of the drive transistor 111, the first reset sub-circuit 114, and the second reset sub-circuit 116, and the energy storage element 117 and configured to change a gate voltage of the drive transistor 111. In an example, the switch sub-circuit 115 and the drive transistor 111 are mirrored in the pixel circuit 110 and disposed adjacent to each other.

The second reset sub-circuit 116 is electrically coupled with the first reset signal terminal 106 and the switch sub-circuit 115, and configured to respond to the first reset signal Scan 2 written at the first reset signal terminal 106.

The energy storage element 117 is electrically coupled with the gate of the drive transistor 111, the first reset sub-circuit 114, a switch sub-circuit 115, a third reset sub-circuit 118, and a data writing sub-circuit 119, and configured to change the gate voltage of the drive transistor 111.

The third reset sub-circuit 118 is electrically coupled with a second reset signal terminal 107, the energy storage element 117, and the data writing sub-circuit 119, and configured to respond to a second reset signal Scan3 written at the second reset signal terminal 107.

The data writing sub-circuit 119 is electrically coupled with a data voltage terminal 108, a scan signal terminal 109, the third reset sub-circuit 118, and the energy storage element 117, and configured to write a data voltage $V_{data}$ written at the data voltage terminal 108 into a second terminal of the energy storage element 117 in response to a control data writing signal Scan1 written at the scan signal terminal 109.

The disclosure aims at providing the pixel circuit 110, which solves a problem of uneven display brightness and unstable display of a display screen due to uneven light emission of a light-emitting element caused by a threshold voltage drift in a thin film transistor (TFT).

Figure 3:
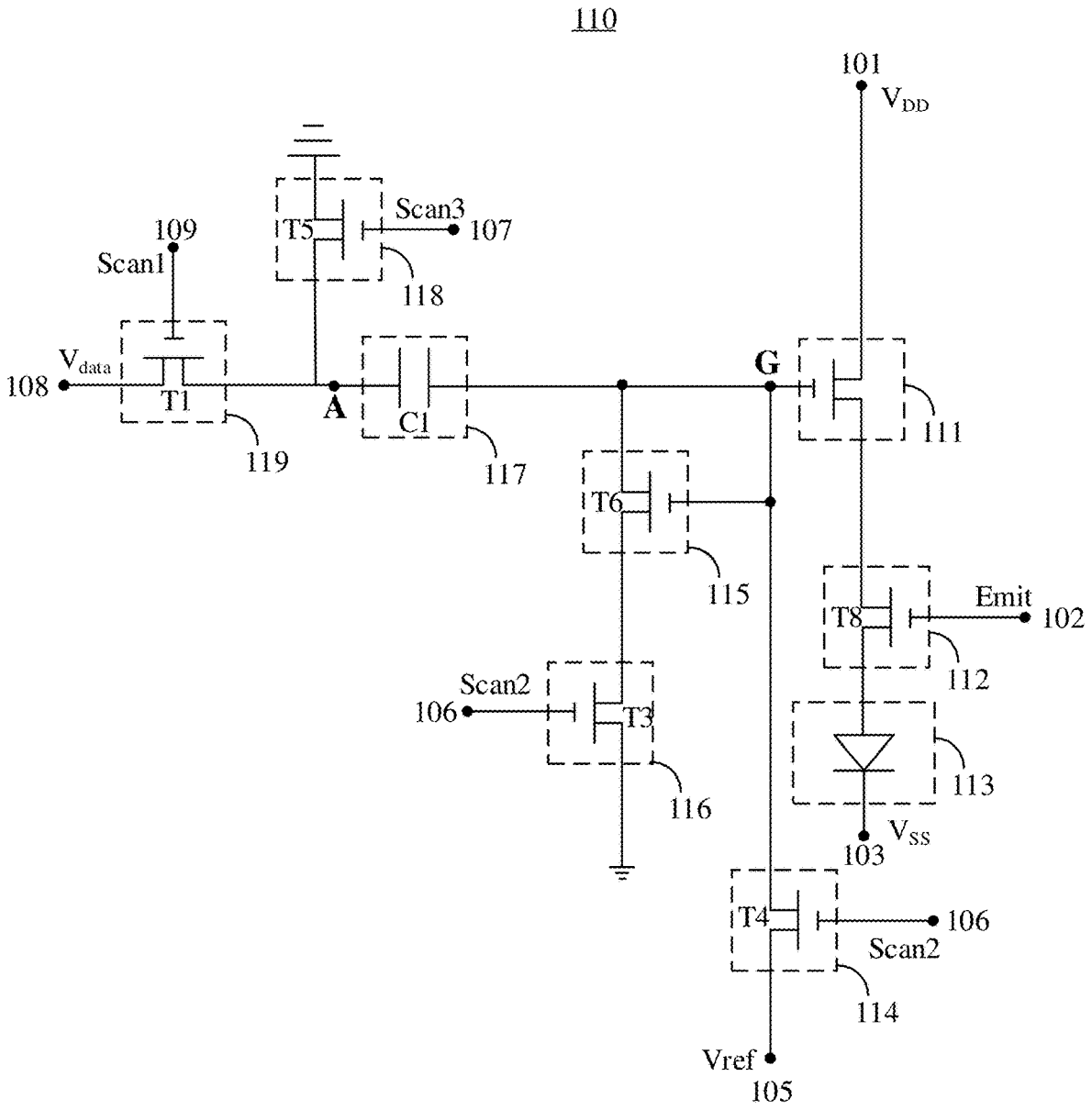
FIG. 3 is a schematic circuit diagram of a pixel circuit provided in a second embodiment of the disclosure.

Refer to FIG. 3, which is a schematic circuit diagram of a pixel circuit provided in a second embodiment of the disclosure. As illustrated in FIG. 3, the light-emitting control sub-circuit 112 in the pixel circuit 110 provided in the disclosure includes a light-emitting control transistor T8. The light-emitting control transistor T8 has a control terminal configured to receive the light-emitting control signal Emit, a first terminal electrically coupled with the drain of the drive transistor 111, and a second terminal electrically coupled with a positive electrode of the light-emitting unit 113. In an embodiment of the disclosure, when the light-emitting control signal Emit is a low-level signal, the light-emitting control transistor T8 is switched on in response to the light-emitting control signal Emit, so that a current drives the light-emitting unit 113 to emit light.

The first reset sub-circuit 114 includes a first reset transistor T4. The first reset transistor T4 has a control terminal configured to receive the first reset signal Scan2, a first terminal electrically coupled with the gate of the drive transistor 111, the switch sub-circuit 115, and the energy storage element 117, and a second terminal electrically coupled with the reference voltage terminal 105, and the first reset transistor T4 is configured to receive the reference voltage $V_{ref}$ written at the reference voltage terminal 105. In an embodiment of the disclosure, when the first reset signal Scan2 is a low-level signal, the first reset transistor T4 is switched on in response to the first reset signal Scan2, and the reference voltage $V_{ref}$ is written into the gate of the drive transistor 111 and the first terminal of the energy storage element 117 through the first reset transistor T4.

The switch sub-circuit 115 includes a first switch transistor T6. The first switch transistor T6 has a gate electrically coupled with the gate of the drive transistor 111 and a first terminal of the first reset transistor T4, a source electrically coupled with the gate of the drive transistor 111 and the energy storage element 117, and a drain electrically coupled with the second reset sub-circuit 116. In an embodiment of the disclosure, the first switch transistor T6 and the drive transistor 111 are manufactured through the same process, and thus a threshold voltage of the first switch transistor T6 is equal to that of the drive transistor 111.

The second reset sub-circuit 116 includes a second reset transistor T3. The second reset transistor T3 has a control terminal configured to receive the first reset signal Scan2, a second terminal which is grounded, and a first terminal electrically coupled with the drain of the first switch transistor T6. In an embodiment of the disclosure, when the first reset signal Scan2 is a low-level signal, the second reset transistor T3 is switched on in response to the first reset signal Scan2.

The energy storage element 117 includes a storage capacitor C1. The storage capacitor C1 has a first terminal electrically coupled with the gate of the drive transistor 111, the first terminal of the first reset transistor T4, and the source of the first switch transistor T6, and a second terminal electrically coupled with the third reset sub-circuit 118 and the data writing sub-circuit 119, and the storage capacitor is configured to change the gate voltage of the drive transistor 111.

The third reset sub-circuit 118 includes a third reset transistor T5. The third reset transistor T5 has a control terminal configured to receive the second reset signal Scan3, a second terminal which is grounded, and a first terminal electrically coupled with the second terminal of the storage capacitor C1 and the data writing sub-circuit 119. In an embodiment of the disclosure, when the second reset signal Scan3 is a low-level signal, the third reset transistor T5 is switched on in response to the second reset signal Scan3, and the second terminal of the energy storage element 117 is grounded through the third reset transistor T5.

The data writing sub-circuit 119 includes a second switch transistor T1. The second switch transistor T1 has a control terminal configured to receive the control data writing signal Scan1, a second terminal configured to receive the data voltage $V_{data}$, and a first terminal electrically coupled with the second terminal of the storage capacitor C1 and the first terminal of the third reset transistor T5. In an embodiment of the disclosure, when the control data writing signal Scan1 is a low-level signal, the second switch transistor T1 is switched on in response to the control data writing signal Scan1, and the data voltage $V_{data}$ is written into the second terminal of the storage capacitor C1 through the second switch transistor T1.

The transistors illustrated in the embodiment in FIG. 3 are all P-type transistors. It is noted that, implementations where N-type transistors are adopted can be easily conceived by those skilled in the art without creative efforts, and thus also fall within the protection scope of the embodiments of the disclosure. It is noted here that, transistors used in the embodiments of the disclosure may be TFTs, field effect transistors (FETs), or other elements with the same characteristics. Since a source and a drain of the transistor used herein are symmetrical, there is no difference between the source and the drain of the transistor.

Figure 4:
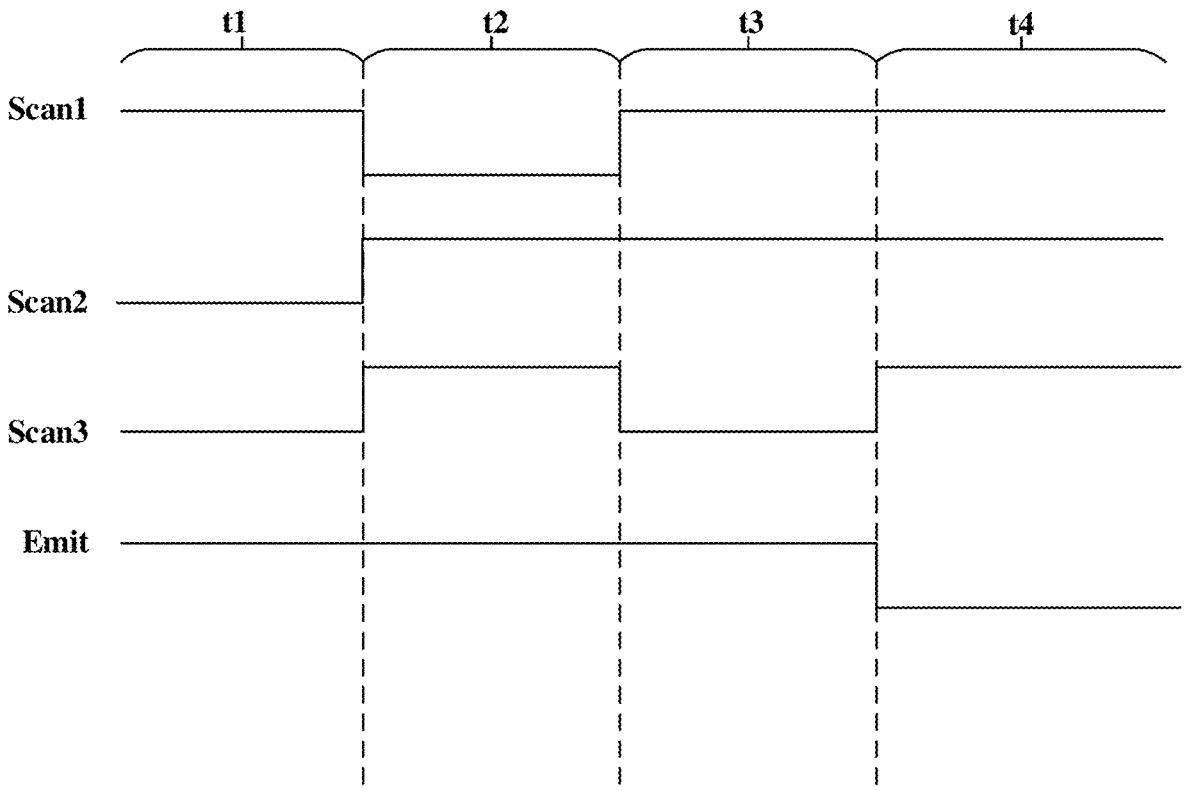
FIG. 4 is a timing diagram of the pixel circuit illustrated in FIG. 3.

The timing diagram corresponding to the pixel circuit 110 illustrated in FIG. 3 is illustrated in FIG. 4. Specifically, four periods of t1, t2, t3, and t4 in the timing diagram illustrated in FIG. 4 are selected. The timing diagram of the pixel circuit 110 illustrated in FIG. 4 will be described in detail in the following embodiments.

Specifically, "1" represents a high potential, and "0" represents a low potential. It is noted that "1" and "0" represent logic potentials, which are only to better explain specific operating processes of the embodiments of the disclosure, rather than potentials applied to gates of the transistors during specific implementing processes. In this embodiment, since all transistors are P-type transistors, the first terminal of the second switch transistor, the first terminal of the second reset transistor, the first terminal of the first reset transistor, the first terminal of the third reset transistor, and the first terminal of the light-emitting control transistor are all drains, the second terminal of the second switch transistor, the second terminal of the second reset transistor, the second terminal of the first reset transistor, the second terminal of the third reset transistor, and the second terminal of the light-emitting control transistor are all sources, the control terminal of the second switch transistor, the control terminal of the second reset transistor, the control terminal of the first reset transistor, the control terminal of the third reset transistor, and the control terminal of the light-emitting control transistor are gates, thus an effective signal is a low-level signal.

In period t1, the control data writing signal Scan1=1, the first reset signal Scan2=0, the second reset signal Scan3=0, and the light-emitting control signal Emit=1.

Specifically, when the first reset signal Scan2 and the second reset signal Scan3 are low-level signals and the control data writing signal Scan1 and the light-emitting control signal Emit are high-level signals, the second switch transistor T1 and the light-emitting control transistor T8 are switched off, and the second reset transistor T3, the first reset transistor T4, the third reset transistor T5, and the first switch transistor T6 are all switched on. The first reset transistor T4 is switched on, thus the reference voltage $V_{ref}$ written at the reference voltage terminal 105 is transmitted to the gate of the drive transistor 111 and the first terminal of the storage capacitor C1 through the first reset transistor T4, and thus a voltage value of the gate of the drive transistor 111 (i.e., point G illustrated in FIG. 3) and a voltage value of the first terminal of the storage capacitor C1 are both $V_{ref}$. The third reset transistor T5 is switched on, thus the second terminal of the storage capacitor C1 is grounded through the third reset transistor T5, and a voltage value of the second terminal of the storage capacitor C1 (i.e., point A illustrated in FIG. 3) is zero. When the voltage value of the gate of the drive transistor 111 is $V_{ref}$, the drive transistor 111 is switched on, and the first power supply voltage $V_{DD}$ written at the first power supply voltage terminal 101 is transmitted to the source of the drive transistor 111, thus a voltage value of the source of the drive transistor 111 is $V_{DD}$. The reference voltage $V_{ref}=V_{th2}=V_{th6}$, $V_G=V_{ref}$, $V_S=V_{DD}$, $V_{C11}=V_{ref}$, and $V_{C12}=0$, and thus $V_{Gs}=V_{DD}+|V_{th2}|$, and $V_{C1}=V_{ref}=V_{th2}=V_{th6}$.

In period t2, the control data writing signal Scan1=0, the first reset signal Scan2=1, the second reset signal Scan3=1, and the light-emitting control signal Emit=1.

Specifically, when the control data writing signal Scan1 is a low-level signal and the first reset signal Scan2, the second reset signal Scan3, and the light-emitting control signal Emit are all high-level signals, the second switch transistor T1 is switched on, and the second reset transistor T3, the first reset transistor T4, the third reset transistor T5, the first switch transistor T6, and the light-emitting control transistor T8 are all switched off. Thus, the second switch transistor T1 is switched on, and the data voltage $V_{data}$ written at the data voltage terminal 108 is transmitted to the second terminal of the storage capacitor C1 through the second switch transistor T1, thus the voltage value of the second terminal of the storage capacitor C1 (i.e., point A illustrated in FIG. 3) is $V_{data}$, the voltage value of the first terminal of the storage capacitor C1 is $V_{ref}$, and a voltage difference of the storage capacitor C1 is $V_{C1}=V_{data}+V_{ref}=V_{data}+|V_{th2}|$. A voltage at point G is stable, thus the voltage value of the gate of the drive transistor 111 is $V_{ref}$, the drive transistor 111 is switched on, and the first power supply voltage $V_{DD}$ written at the first power supply voltage terminal 101 is transmitted to the source of the drive transistor 111, thus the source voltage of the drive transistor 111 is $V_{DD}$, and a voltage difference between the gate and the source of the drive transistor 111 is $V_{Gs}=V_{DD}+|V_{th2}|$.

In period t3, the control data writing signal Scan1=1, the first reset signal Scan2=1, the second reset signal Scan3=0, and the light-emitting control signal Emit=1.

Specifically, when the second reset signal is a low-level signal, and the control data writing signal Scan1, the first reset signal Scan2, and the light-emitting control signal Emit are all high-level signals, the third reset transistor T5 is switched on and the drive transistor 111 is switched on. When the third reset transistor T5 is switched on, the second terminal of the storage capacitor C1 is grounded through the third reset transistor T5, thus the voltage value of the second terminal of the storage capacitor C1 (i.e., point A illustrated in FIG. 3) is zero, and the storage capacitor C1 is floating. When the drive transistor 111 is switched on, and the first power supply voltage $V_{DD}$ written at the first power supply voltage terminal 101 is transmitted to the source of the drive transistor 111, thus the source voltage of the drive transistor 111 is $V_{DD}$, the gate voltage of the drive transistor 111 is $V_{data}+|V_{th2}|$, the voltage difference between the gate and the source of the drive transistor 111 is $V_{Gs}=V_{DD}-(V_{data}+|V_{th2}|)$, and the drive current $I_L$ flowing through the light-emitting unit 113 is expressed as follows:

$$I_L=k(V_{gs}-V_{th})^2=k(V_{Gs}+|V_{th}|)^2=k(V_{DD}-V_{data}-|V_{th2}|+|V_{thr}|)^2=k(V_{DD}-V_{data})^2 \quad \text{Expression (1)}$$

Therefore, the drive current flowing through the light-emitting unit 113 is irrelevant to the threshold voltage $V_{th2}$ of the drive transistor 111, the threshold voltage $V_{th2}$ of the drive transistor 111 has no effect on the drive current of the light-emitting unit 113, and the drive current is in a stable state and is capable of driving the light-emitting unit 113 to emit light.

In period t4, the control data writing signal Scan1=1, the first reset signal Scan2=1, the second reset signal Scan3=1, and the light-emitting control signal Emit=0.

Specifically, when the light-emitting control signal Emit is a low-level signal and the control data writing signal Scan1, the first reset signal Scan2, and the second reset signal Scan3 are all high-level signals, the light-emitting control transistor T8 is switched on, and the second switch transistor T1, the second reset transistor T3, the first reset transistor T4, the third reset transistor T5, and the first switch transistor T6 are all switched off. Thus, the light-emitting control transistor T8 is switched on, and current is transmitted to the light-emitting unit 113 through the light-emitting control transistor T8, so that the light-emitting unit 113 emits light.

In conclusion, in the pixel circuit 110 provided in the embodiments of the disclosure, when the light-emitting unit 113 is driven to emit light by the drive transistor 111, a corresponding drive current flows through the light-emitting unit 113. A value of the corresponding drive current is related to the first power supply voltage $V_{DD}$ written at the first power supply voltage terminal 101 and the data voltage $V_{data}$ written at the data voltage terminal 108, but irrelevant to the threshold voltage of the drive transistor 111, as such, the drive current is prevented from being affected by the threshold voltage, a problem of uneven display brightness and unstable display caused by the threshold voltage in the pixel circuit is solved, thereby effectively improving overall brightness uniformity and stability of the display apparatus. At the same time, when the light-emitting unit 113 does not emit light, the light-emitting control transistor T8 can be controlled by the light-emitting control signal to achieve a full-black display. Moreover, the light-emitting unit 113 will be reset before emitting light and the reference voltage $V_{ref}$ will be written into the first reset sub-circuit 114, thus avoiding residual images of the light-emitting unit 113 due to different operating time.

Figure 5:
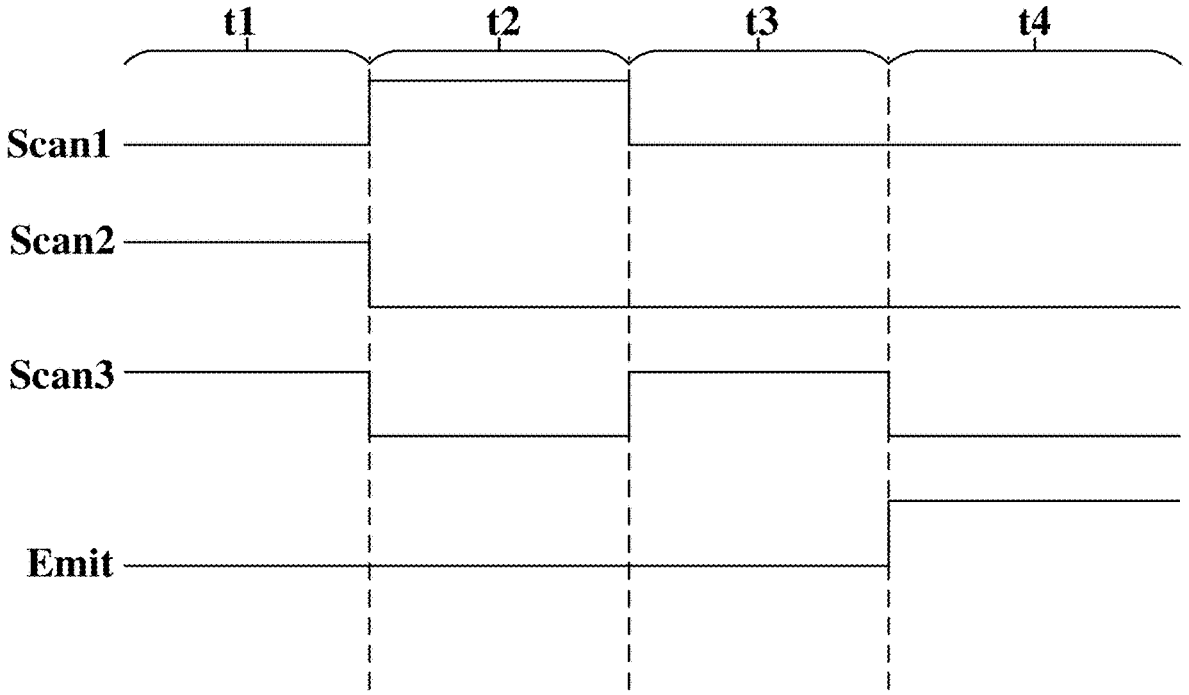
FIG. 5 is another timing diagram of the pixel circuit illustrated in FIG. 3.

The timing diagram corresponding to the pixel circuit 110 illustrated in FIG. 3 is illustrated in FIG. 5. Specifically, four periods of t1, t2, t3, and t4 in the timing diagram illustrated in FIG. 4 are selected. The timing diagram of the pixel circuit 110 illustrated in FIG. 5 will be described in detail in the following embodiments.

Specifically, "1" represents a high potential, and "0" represents a low potential. It is noted that "1" and "0" are logic potentials, which are only to better explain specific operating processes of the embodiments of the disclosure, rather than potentials applied to gates of the transistors during specific implementing processes. In this embodiment, since the drive transistor 111 and the first switch transistor T6 are both P-type transistors, the effective signal is a low-level signal. The second switch transistor T1, the second reset transistor T3, the first reset transistor T4, the third reset transistor T5, and the light-emitting control transistor T8 are all N-type transistors. In an example, the first terminal of the second switch transistor, the first terminal of the second reset transistor, the first terminal of the first reset transistor, the first terminal of the third reset transistor, and the first terminal of the light-emitting control transistor are all sources, the second terminal of the second switch transistor, the second terminal of the second reset transistor, the second terminal of the first reset transistor, the second terminal of the third reset transistor, and the second terminal of the light-emitting control transistor are all drains, the control terminal of the second switch transistor, the control terminal of the second reset transistor, the control terminal of the first reset transistor, the control terminal of the third reset transistor, and the control terminal of the light-emitting control transistor are gates, thus an effective signal is a high-level signal.

In period t1, the control data writing signal Scan1=0, the first reset signal Scan2=1, the second reset signal Scan3=1, and the light-emitting control signal Emit=0.

Specifically, when the control data writing signal Scan1 and the light-emitting control signal Emit are low-level signals and the first reset signal Scan2 and the second reset signal Scan3 are high-level signals, the second switch transistor T1 and the light-emitting control transistor T8 are switched off, and the second reset transistor T3, the first reset transistor T4, the third reset transistor T5, and the first switch transistor T6 are all switched on. As a result, the first reset transistor T4 is switched on, and the reference voltage $V_{ref}$ written at the reference voltage terminal 105 is transmitted to the gate of the drive transistor 111 and the first terminal of the storage capacitor C1 through the first reset transistor T4, and thus the gate of the drive transistor 111 (i.e., point G illustrated in FIG. 3) and the voltage value of the first terminal of the storage capacitor C1 are both $V_{ref}$. The third reset transistor T5 is switched on, the second terminal of the storage capacitor C1 is grounded through the third reset transistor T5, and the voltage value of the second terminal of the storage capacitor C1 (i.e., point A illustrated in FIG. 3) is zero. The drive transistor 111 is switched on, and the first power supply voltage $V_{DD}$ written at the first power supply voltage terminal 101 is transmitted to the source of the drive transistor 111, thus a voltage value of the source of the drive transistor 111 is $V_{DD}$. Since the reference voltage $V_{ref}=V_{th2}=V_{th6}$, $V_G=V_{ref}$, $V_S=V_{DD}$, $V_{C11}=V_{ref}$, $V_{C12}=0$, $V_{Gs}=V_{DD}+|V_{th2}|$, $V_{C1}=V_{ref}=V_{th2}=V_{th6}$.

In period t2, the control data writing signal Scan1=1, the first reset signal Scan2=0, the second reset signal Scan3=0, and the light-emitting control signal Emit=0.

Specifically, when the first reset signal Scan2, the second reset signal Scan3 and the light-emitting control signal Emit are all low-level signals, and the control data writing signal Scan1 is a high-level signal, the second switch transistor T1 is switched on, and the second reset transistor T3, the first reset transistor T4, the third reset transistor T5, the first switch transistor T6, and the light-emitting control transistor T8 are all switched off. Thus, the second switch transistor T1 is switched on, and the data voltage $V_{data}$ written at the data voltage terminal 108 is transmitted to the second terminal of the storage capacitor C1 through the second switch transistor T1, thus the voltage value of the second terminal of the storage capacitor C1 (i.e., point A illustrated in FIG. 3) is $V_{data}$, the voltage value of the first terminal of the storage capacitor C1 is $V_{ref}$, and a voltage difference of the storage capacitor C1 is $V_{C1}=V_{data}+V_{ref}=V_{data}+|V_{th2}|$. The drive transistor 111 is switched on, and the first power supply voltage $V_{DD}$ written at the first power supply voltage terminal 101 is transmitted to the source of the drive transistor 111, thus the source voltage of the drive transistor 111 is $V_{DD}$, and a voltage difference between the gate and the source of the drive transistor 111 is $V_{Gs}=V_{DD}+|V_{th2}|$.

In period t3, the control data writing signal Scan1=0, the first reset signal Scan2=0, the second reset signal Scan3=1, and the light-emitting control signal Emit=0.

Specifically, when the control data writing signal Scan1, the first reset signal Scan2, and the light-emitting control signal Emit are all low-level signals and the second reset signal is a high-level signal, the third reset transistor T5 is switched on, the second terminal of the storage capacitor C1 is grounded through the third reset transistor T5, thus the voltage value of the second terminal of the storage capacitor C1 (i.e., point A illustrated in FIG. 3) is zero, and the storage capacitor C1 is floating. The drive transistor 111 is switched on, and the first power supply voltage $V_{DD}$ written at the first power supply voltage terminal 101 is transmitted to the source of the drive transistor 111, thus the source voltage of the drive transistor 111 is $V_{DD}$, the gate voltage of the drive transistor 111 is $V_{data}+|V_{th2}|$, the voltage difference between the gate and the source of the drive transistor 111 is $V_{Gs}=V_{DD}-(V_{data}+|V_{th2}|)$, and the drive current $I_L$ flowing through the light-emitting unit 113 can be expressed as the following expression:

$$I_L=k(V_{gs}-V_{th})^2=k(V_{Gs}+|V_{th}|)^2=k(V_{DD}-V_{data}-|V_{th2}|+|V_{thr}|)^2=k(V_{DD}-V_{data})^2 \quad \text{Expression (1)}$$

Therefore, the drive current flowing through the light-emitting unit 113 is unrelated to the threshold voltage $V_{th2}$ of the drive transistor 111, the threshold voltage $V_{th2}$ of the drive transistor 111 has no effect on the drive current of the light-emitting unit 113, and the drive current is in a stable state and is capable of driving the light-emitting unit 113 to emit light.

In period t4, the control data writing signal Scan1=0, the first reset signal Scan2=0, the second reset signal Scan3=0, and the light-emitting control signal Emit=1.

Specifically, when the control data writing signal Scan1, the first reset signal Scan2, and the second reset signal Scan3 are all low-level signals and the light-emitting control signal Emit is a high-level signal, the light-emitting control transistor T8 is switched on, and the second switch transistor T1, the second reset transistor T3, the first reset transistor T4, the third reset transistor T5, and the first switch transistor T6 are all switched off. Thus, the light-emitting control transistor T8 is switched on, and the light-emitting control transistor T8 transmits current to the light-emitting unit 113, so that the light-emitting unit 113 emits light.

In conclusion, in the pixel circuit 110 provided in the embodiments of the disclosure, when the light-emitting unit 113 is driven to emit light by the drive transistor 111, a corresponding drive current flows through the light-emitting unit 113. A value of the corresponding drive current is related to the first power supply voltage $V_{DD}$ written at the first power supply voltage terminal 101 and the data voltage $V_{data}$ written at the data voltage terminal 108, but unrelated to the threshold voltage of the drive transistor 111, as such, the drive current is prevented from being affected by the threshold voltage, a problem of uneven display brightness and unstable display caused by the threshold voltage in the pixel circuit is solved, thereby effectively improving overall brightness uniformity and stability of the display apparatus. At the same time, when the light-emitting unit 113 is not emitting light, the light-emitting control transistor T8 can be controlled by the light-emitting control signal to achieve a full-black display. Moreover, the light-emitting unit 113 will be reset before emitting light and the reference voltage $V_{ref}$ will be written into the first reset sub-circuit 114, thus avoiding residual images of the light-emitting unit 113 due to different operating time.

In a second aspect, a display panel 10 is provided. Refer to FIG. 1, the display panel 10 has the active area 100 and the inactive area 200 surrounding the active area 100. The display panel 10 is provided with multiple pixel circuits 110 provided in the first aspect. The multiple pixel circuits 110 are disposed in the active area 100 for image display. The multiple pixel circuits 110 are arranged in a matrix array.

In a third aspect, a display apparatus is further provided. The display apparatus includes a signal generating circuit and the above-mentioned display panel 10. The signal generating circuit is configured to provide the display panel with scan driving signals, data driving signals, and control signals.

In the display apparatus provided in the embodiments of the disclosure, when the light-emitting unit 113 is not emitting light, the light-emitting control transistor T8 can be controlled by the light-emitting control signal to achieve a full-black display.

In the embodiments of the disclosure, the display panel may be an active-matrix organic light-emitting diode (AMOLED) panel.

In the embodiments of the disclosure, the display apparatus may be any electronic device or component with a display function, such as a mobile phone, a tablet computer, a navigator, a display, etc., which is not specifically limited herein.

The flow chart described in the disclosure is only one embodiment, and there may be various modifications and variations to this explanatory chart or steps in the disclosure without departing from the spirit of the disclosure. For example, the steps may be performed in a different order, or certain steps may be added, deleted, or modified. Those skilled in the art can understand that all or part of flows for realizing the above embodiments, and equivalent variations made in accordance with the claims of the disclosure, still fall within the scope of the disclosure.

In the illustration of the disclosure, descriptions with reference to terms "one embodiment", "some embodiments", "examples", "specific examples", or "some examples" and the like mean that specific features, structures, materials, or characteristics described in combination with the embodiments or examples are included in at least one embodiment or example of the disclosure. The schematic expressions of the above terms herein do not necessarily refer to the same embodiment or example. Moreover, the particular features, structures, materials, or characteristics described may be combined in any suitable manner in any one or more embodiments or examples.

It is understood that the disclosure is not to be limited to the above-identified embodiments. Those of ordinary skill in the art can make improvements or changes based on the above description, and all these improvements and changes should fall within the protection scope of the appended claims of the disclosure. Those of ordinary skill in the art can understand that all or part of methods for realizing the above embodiments, and equivalent changes made in accordance with the claims of the disclosure, still fall within the scope covered by the disclosure.

What is claimed is:

1. A pixel circuit, comprising:

a light-emitting unit electrically coupled with a second power supply voltage terminal;

a drive transistor, wherein the drive transistor has a gate electrically coupled with a first reset sub-circuit, a switch sub-circuit, and an energy storage element, a source electrically coupled with a first power supply voltage terminal, and a drain electrically coupled with a light-emitting control sub-circuit, and the drive transistor is configured to drive the light-emitting unit to emit light;

the light-emitting control sub-circuit electrically coupled with a light-emitting control signal terminal and the light-emitting unit, and configured to control the light-emitting unit to emit light in response to a light-emitting control signal written at the light-emitting control signal terminal;

the first reset sub-circuit electrically coupled with a reference voltage terminal, a first reset signal terminal, the switch sub-circuit, and the energy storage element, and configured to write a reference voltage written at the reference voltage terminal into the gate of the drive transistor and a first terminal of the energy storage element in respond to a first reset signal written at the first reset signal terminal;

the switch sub-circuit electrically coupled with a second reset sub-circuit and the energy storage element and configured to change a gate voltage of the drive transistor;

the second reset sub-circuit electrically coupled with the first reset signal terminal and configured to respond to the first reset signal;

the energy storage element electrically coupled with a third reset sub-circuit and a data writing sub-circuit and configured to change the gate voltage of the drive transistor;

the third reset sub-circuit electrically coupled with a second reset signal terminal and the data writing sub-circuit and configured to respond to a second reset signal written at the second reset signal terminal; and the data writing sub-circuit electrically coupled with a data voltage terminal and a scan signal terminal and configured to write a data voltage written at the data voltage terminal into a second terminal of the energy storage element in respond to a control data writing signal written at the scan signal terminal.

2. The pixel circuit of claim 1, wherein the light-emitting control sub-circuit comprises a light-emitting control transistor, wherein the light-emitting control transistor has a control terminal configured to receive the light-emitting control signal, a first terminal electrically coupled with the drain of the drive transistor, and a second terminal electrically coupled with a positive electrode of the light-emitting unit, and the light-emitting control transistor is configured to drive the light-emitting unit to emit light in response to the light-emitting control signal.

3. The pixel circuit of claim 2, wherein the first reset sub-circuit comprises a first reset transistor, wherein the first reset transistor has a control terminal configured to receive the first reset signal, a first terminal electrically coupled with the gate of the drive transistor, the switch sub-circuit, and the energy storage element, and a second terminal electrically coupled with the reference voltage terminal, and the first reset transistor is configured to receive the reference voltage written at the reference voltage terminal.

4. The pixel circuit of claim 3, wherein the switch sub-circuit comprises a first switch transistor, wherein the first switch transistor has a gate electrically coupled with the gate of the drive transistor and a first terminal of the first reset transistor, a source electrically coupled with the gate of the drive transistor and the energy storage element, and a drain electrically coupled with the second reset sub-circuit.

5. The pixel circuit of claim 4, wherein the second reset sub-circuit comprises a second reset transistor, wherein the second reset transistor has a control terminal configured to receive the first reset signal, a second terminal which is grounded, and a first terminal electrically coupled with the drain of the first switch transistor.

6. The pixel circuit of claim 5, wherein the energy storage element comprises a storage capacitor, wherein the storage capacitor has a first terminal electrically coupled with the gate of the drive transistor, the first terminal of the first reset transistor, and the source of the first switch transistor, and a second terminal electrically coupled with the third reset sub-circuit and the data writing sub-circuit, and the storage capacitor is configured to change the gate voltage of the drive transistor.

7. The pixel circuit of claim 6, wherein the third reset sub-circuit comprises a third reset transistor, wherein the third reset transistor has a control terminal configured to receive the second reset signal, a second terminal which is grounded, and a first terminal electrically coupled with the second terminal of the storage capacitor and the data writing sub-circuit.

8. The pixel circuit of claim 7, wherein the data writing sub-circuit comprises a second switch transistor, wherein the second switch transistor has a control terminal configured to receive the control data writing signal, a second terminal configured to receive the data voltage, and a first terminal electrically coupled with the second terminal of the storage capacitor and the first terminal of the third reset transistor.

9. The pixel circuit of claim 8, wherein the drive transistor and the first switch transistor are both P-type transistors, and the second switch transistor, the second reset transistor, the first reset transistor, the third reset transistor, and the light-emitting control transistor are all N-type transistors; or the drive transistor, the first switch transistor, the second switch transistor, the second reset transistor, the first reset transistor, the third reset transistor, and the light-emitting control transistor are all P-type transistors.

10. A display panel having an active area and an inactive area surrounding the active area, the display panel comprising a plurality of pixel circuits arranged in the active area, wherein each of the plurality of pixel circuits comprises:

a light-emitting unit electrically coupled with a second power supply voltage terminal;

a drive transistor, wherein the drive transistor has a gate electrically coupled with a first reset sub-circuit, a switch sub-circuit, and an energy storage element, a source electrically coupled with a first power supply voltage terminal, and a drain electrically coupled with a light-emitting control sub-circuit, and the drive transistor is configured to drive the light-emitting unit to emit light;

the light-emitting control sub-circuit electrically coupled with a light-emitting control signal terminal and the light-emitting unit, and configured to control the light-emitting unit to emit light in response to a light-emitting control signal written at the light-emitting control signal terminal;

the first reset sub-circuit electrically coupled with a reference voltage terminal, a first reset signal terminal, the switch sub-circuit, and the energy storage element, and configured to write a reference voltage written at the reference voltage terminal into the gate of the drive transistor and a first terminal of the energy storage element in respond to a first reset signal written at the first reset signal terminal;

the switch sub-circuit electrically coupled with a second reset sub-circuit and the energy storage element and configured to change a gate voltage of the drive transistor;

the second reset sub-circuit electrically coupled with the first reset signal terminal and configured to respond to the first reset signal;

the energy storage element electrically coupled with a third reset sub-circuit and a data writing sub-circuit and configured to change the gate voltage of the drive transistor;

the third reset sub-circuit electrically coupled with a second reset signal terminal and the data writing sub-circuit and configured to respond to a second reset signal written at the second reset signal terminal; and the data writing sub-circuit electrically coupled with a data voltage terminal and a scan signal terminal and configured to write a data voltage written at the data voltage terminal into a second terminal of the energy storage element in respond to a control data writing signal written at the scan signal terminal.

11. The display panel of claim 10, wherein the light-emitting control sub-circuit comprises a light-emitting control transistor, wherein the light-emitting control transistor has a control terminal configured to receive the light-emitting control signal, a first terminal electrically coupled with the drain of the drive transistor, and a second terminal electrically coupled with a positive electrode of the light-emitting unit, and the light-emitting control transistor is configured to drive the light-emitting unit to emit light in response to the light-emitting control signal.

12. The display panel of claim 11, wherein the first reset sub-circuit comprises a first reset transistor, wherein the first reset transistor has a control terminal configured to receive the first reset signal, a first terminal electrically coupled with the gate of the drive transistor, the switch sub-circuit, and the energy storage element, and a second terminal electrically coupled with the reference voltage terminal, and the first reset transistor is configured to receive the reference voltage written at the reference voltage terminal.

13. The display panel of claim 12, wherein the switch sub-circuit comprises a first switch transistor, wherein the first switch transistor has a gate electrically coupled with the gate of the drive transistor and a first terminal of the first reset transistor, a source electrically coupled with the gate of the drive transistor and the energy storage element, and a drain electrically coupled with the second reset sub-circuit.

14. The display panel of claim 13, wherein the second reset sub-circuit comprises a second reset transistor, wherein the second reset transistor has a control terminal configured to receive the first reset signal, a second terminal which is grounded, and a first terminal electrically coupled with the drain of the first switch transistor.

15. The display panel of claim 14, wherein the energy storage element comprises a storage capacitor, wherein the storage capacitor has a first terminal electrically coupled with the gate of the drive transistor, the first terminal of the first reset transistor, and the source of the first switch transistor, and a second terminal electrically coupled with the third reset sub-circuit and the data writing sub-circuit, and the storage capacitor is configured to change the gate voltage of the drive transistor.

16. The display panel of claim 15, wherein the third reset sub-circuit comprises a third reset transistor, wherein the third reset transistor has a control terminal configured to receive the second reset signal, a second terminal which is grounded, and a first terminal electrically coupled with the second terminal of the storage capacitor and the data writing sub-circuit.

17. The display panel of claim 16, wherein the data writing sub-circuit comprises a second switch transistor, wherein the second switch transistor has a control terminal configured to receive the control data writing signal, a second terminal configured to receive the data voltage, and a first terminal electrically coupled with the second terminal of the storage capacitor and the first terminal of the third reset transistor.

18. The display panel of claim 17, wherein the drive transistor and the first switch transistor are both P-type transistors, and the second switch transistor, the second reset transistor, the first reset transistor, the third reset transistor, and the light-emitting control transistor are all N-type transistors; or the drive transistor, the first switch transistor, the second switch transistor, the second reset transistor, the first reset transistor, the third reset transistor, and the light-emitting control transistor are all P-type transistors.

19. A display apparatus, comprising a signal generating circuit and a display panel, the signal generating circuit being configured to provide the display panel with scan driving signals, data driving signals, and control signals, the display panel having an active area and an inactive area surrounding the active area, and the display panel comprising a plurality of pixel circuits arranged in the active area, wherein each of the plurality of pixel circuits comprises:

a light-emitting unit electrically coupled with a second power supply voltage terminal;

a drive transistor, wherein the drive transistor has a gate electrically coupled with a first reset sub-circuit, a switch sub-circuit, and an energy storage element, a source electrically coupled with a first power supply voltage terminal, and a drain electrically coupled with a light-emitting control sub-circuit, and the drive transistor is configured to drive the light-emitting unit to emit light;

the light-emitting control sub-circuit electrically coupled with a light-emitting control signal terminal and the light-emitting unit, and configured to control the light-emitting unit to emit light in response to a light-emitting control signal written at the light-emitting control signal terminal;

the first reset sub-circuit electrically coupled with a reference voltage terminal, a first reset signal terminal, the switch sub-circuit, and the energy storage element, and configured to write a reference voltage written at the reference voltage terminal into the gate of the drive transistor and a first terminal of the energy storage element in respond to a first reset signal written at the first reset signal terminal;

the switch sub-circuit electrically coupled with a second reset sub-circuit and the energy storage element and configured to change a gate voltage of the drive transistor;

the second reset sub-circuit electrically coupled with the first reset signal terminal and configured to respond to the first reset signal;

the energy storage element electrically coupled with a third reset sub-circuit and a data writing sub-circuit and configured to change the gate voltage of the drive transistor;

the third reset sub-circuit electrically coupled with a second reset signal terminal and the data writing sub-circuit and configured to respond to a second reset signal written at the second reset signal terminal; and the data writing sub-circuit electrically coupled with a data voltage terminal and a scan signal terminal and configured to write a data voltage written at the data voltage terminal into a second terminal of the energy storage element in respond to a control data writing signal written at the scan signal terminal.

20. The display apparatus of claim 19, wherein the light-emitting control sub-circuit comprises a light-emitting control transistor, wherein the light-emitting control transistor has a control terminal configured to receive the light-emitting control signal, a first terminal electrically coupled with the drain of the drive transistor, and a second terminal electrically coupled with a positive electrode of the light-emitting unit, and the light-emitting control transistor is configured to drive the light-emitting unit to emit light in response to the light-emitting control signal.

* * * * *